US007203454B2

(12) United States Patent
Terao et al.

(10) Patent No.: US 7,203,454 B2
(45) Date of Patent: Apr. 10, 2007

(54) SHEET POST-PROCESS APPARATUS AND WAITING TRAY

(75) Inventors: Yasunobu Terao, Tagata-gun (JP); Yoshiaki Sugizaki, Sunto-gun (JP); Mikio Yamamoto, Tagata-gun (JP); Tomomi Iijima, Mishima (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,247

(22) Filed: Dec. 10, 2004

(65) Prior Publication Data

US 2006/0067769 A1 Mar. 30, 2006

(30) Foreign Application Priority Data

Sep. 28, 2004 (JP) ..... 2004-281772

(51) Int. Cl.
*G03G 15/00* (2006.01)
*B65H 33/04* (2006.01)

(52) U.S. Cl. ..... 399/405; 399/407; 270/37; 270/58.08

(58) Field of Classification Search ..... 399/405, 399/407; 270/37, 58.08
See application file for complete search history.

(56) References Cited

U.S. PATENT DOCUMENTS 4,473,425 A 9/1984 Baughman et al.
4,611,741 A 9/1986 Wilson
4,794,859 A * 1/1989 Huseby et al. ..... 101/485
4,898,374 A 2/1990 Vermaat
5,021,837 A 6/1991 Uto et al.
5,098,074 A 3/1992 Mandel et al.
5,282,611 A 2/1994 Ueda et al.
5,285,249 A 2/1994 Mahoney
5,289,251 A 2/1994 Mandel et al.
5,435,544 A 7/1995 Mandel (Continued)

FOREIGN PATENT DOCUMENTS

JP 62-008965 A 1/1987

(Continued)

OTHER PUBLICATIONS

U.S. Appl. No. 11/008,122, filed Dec. 10, 2004, Sasahara.

(Continued)

*Primary Examiner*—Daniel J. Colilla
*Assistant Examiner*—Marvin P. Crenshaw
(74) *Attorney, Agent, or Firm*—Foley & Lardner LLP

(57) ABSTRACT

A sheet post-process apparatus comprises left and right lower face support members which support left and right lower faces in a transport direction of a sheet retained by a waiting tray in a waiting mode, distal end lower face support members which support a distal end lower face of the sheet transmitted to the waiting tray, a distal end upper face retainer member which retains a distal end upper face of the sheet transported to the waiting tray, sensor means for sensing that a sheet has been held on the waiting tray, and a drive motor which, based on a sense signal of the sensor means, drives the distal end upper face retainer member in a location for retaining a distal end upper face of the sheet transported to the waiting tray.

9 Claims, 13 Drawing Sheets

U.S. PATENT DOCUMENTS

| | | | | |
|---|---|---|---|---|
| 5,451,037 | A | 9/1995 | Lundstrom | |
| 5,590,871 | A | 1/1997 | Okabe et al. | |
| 5,628,502 | A | 5/1997 | Amarakoon | |
| 5,676,517 | A | 10/1997 | Lotz | |
| 5,709,376 | A | 1/1998 | Ushirogata | |
| 5,934,140 | A | 8/1999 | Jackson et al. | |
| 5,961,274 | A | 10/1999 | Bors | |
| 5,971,384 | A | 10/1999 | Asao | |
| 6,065,747 | A | 5/2000 | Khovaylo et al. | |
| 6,092,948 | A * | 7/2000 | Altfather | 400/625 |
| 6,142,461 | A | 11/2000 | Asao et al. | |
| 6,220,592 | B1 | 4/2001 | Watanabe et al. | |
| 6,231,039 | B1 | 5/2001 | Chung | |
| 6,330,999 | B2 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,357,753 | B1 | 3/2002 | Yamasaki et al. | |
| 6,450,934 | B1 | 9/2002 | Coombs | |
| 6,581,922 | B2 | 6/2003 | Kuwata et al. | |
| 6,641,129 | B2 | 11/2003 | Ogita et al. | |
| 6,659,455 | B2 | 12/2003 | Endo et al. | |
| 6,671,492 | B2 | 12/2003 | Mimura et al. | |
| 6,698,744 | B2 | 3/2004 | Yamada et al. | |
| 6,712,349 | B2 | 3/2004 | Watanabe | |
| 6,722,646 | B2 | 4/2004 | Sekiyama et al. | |
| 6,722,650 | B1 | 4/2004 | Abbata et al. | |
| 6,733,006 | B2 | 5/2004 | Kobayashi et al. | |
| 6,733,007 | B2 | 5/2004 | Sekiyama et al. | |
| 6,767,012 | B2 | 7/2004 | Sasamoto | |
| 6,819,906 | B1 | 11/2004 | Herrmann et al. | |
| 6,824,128 | B2 | 11/2004 | Nagata et al. | |
| 6,871,042 | B2 | 3/2005 | Nemura et al. | |
| 6,910,686 | B2 | 6/2005 | Awano | |
| 6,928,259 | B2 | 8/2005 | Sakuma | |
| 6,988,728 | B2 | 1/2006 | Kida | |
| 2002/0047233 | A1 | 4/2002 | Coombs et al. | |
| 2002/0053766 | A1 | 5/2002 | Kubota | |
| 2002/0163119 | A1 | 11/2002 | Kawata | |
| 2003/0057625 | A1 | 3/2003 | Kuwata et al. | |
| 2004/0113348 | A1 | 6/2004 | Awano | |
| 2004/0126163 | A1 | 7/2004 | Asami et al. | |
| 2004/0181308 | A1 | 9/2004 | Hayashi et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 2583594 | B2 | 11/1996 |
| JP | 11-322162 | A | 11/1999 |
| JP | 2001-089009 | A | 4/2001 |
| JP | 2003-081517 | A | 3/2003 |

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
Y. Terao et al., Notice of Allowance and Fee(s) Due, U.S. Appl. No. 11/008,132, Oct. 6, 2005, 9 pages.
Y. Terao et al., Notice of Allowance and Fee(s) Due, U.S. Appl. No. 11/008,124, Sep. 30, 2005, 9 pages.
Y. Terao et al., Office Action, U.S. Appl. No. 11/008,122, Nov. 21, 2005, 9 pages.
Y. Terao et al., Office Action, U.S. Appl. No. 11/008,224, Nov. 21, 2005, 10 pages.
Y. Terao et al., Office Action, U.S. Appl. No. 11/008,257, Nov. 30, 2005, 9 pages.
Y. Terao et al., Office Action, U.S. Appl. No. 11/008,271, Nov. 30, 2005, 9 pages.
Y. Terao et al., Office Action, U.S. Appl. No. 11/008,290, Nov. 30, 2005, 9 pages.
Y. Terao et al., Office Action, U.S. Appl. No. 11/008,392, Dec. 14, 2005, 9 pages.
Y. Terao et al., Office Action, U.S. Appl. No. 11/008,294, Dec. 13, 2005, 9 pages.
Y. Terao et al., Office Action, U.S. Appl. No. 11/008,299, Dec. 13, 2005, 9 pages.
Y. Terao et al., Office Action, U.S. Appl. No. 11/008,349, Dec. 13, 2005, 9 pages.
Y. Terao et al., Office Action, U.S. Appl. No. 11/008,567, Dec. 13, 2005, 9 pages.
Y. Terao et al., Office Action, U.S. Appl. No. 11/008,148, Jan. 11, 2006, 12 pages.
Y. Terao et al., Office Action, U.S. Appl. No. 11/008,251, Jan. 13 2006, 11 pages.
Y. Terao et al., Office Action, U.S. Appl. No. 11/008,295, Jan. 5, 2006, 11 pages.
Y. Terao et al., Office Action, U.S. Appl. No. 11/008,350, Jan. 26, 2006, 12 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Terao et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., Notice of Allowance, U.S. Appl. No. 11/085,243, Jan. 5, 2006, with attached Notice of Withdrawal from Issue dated Jan. 10, 2006, 10 pgs.
Y. Terao et al., Office Action, U.S. Appl. No. 11/008,131, Feb. 23, 2006, 9 pgs.
Y. Terao et al., Office Action, U.S. Appl. No. 11/008,222, Feb. 24, 2006, 12 pgs.
Y. Terao et al., Office Action, U.S. Appl. No. 11/008,230, Feb. 24, 2006, 11 pgs.
Y. Terao et al., Office Action, U.S. Appl. No. 11/085,226, Jan. 13, 2006, 9 pgs.
Y. Terao et al., Office Action, U.S. Appl. No. 11/085,227, Feb. 9, 2006, 9 pgs.
Y. Terao et al., Office Action, U.S. Appl. No. 11/085,240, Jan. 26, 2006, 8 pgs.
Y. Terao et al., Office Action, U.S. Appl. No. 11/085,241, Feb. 9, 2006, 9 pgs.
Y. Terao et al., Office Action, U.S. Appl. No. 11/085,243, Jan. 26, 2006, 6 pgs.

Y. Terao et al., Office Action, U.S. Appl. No. 11/085,244, Feb. 9, 2006, 7 pgs.
Y. Terao et al., Notice of Allowance and Fee(s) Due, U.S. Appl. No. 11/085,244, Jul. 13, 2006, 10 pages.
Y. Terao et al., U.S. PTO Office Action, U.S. Appl. No. 11/008,145, Aug. 30, 2006, 6 pgs.
Y. Terao et al., U.S. PTO Office Action, U.S. Appl. No. 11/008,147, Jul. 07, 2006, 4 pgs.
Y. Terao et al., U.S. PTO Office Action, U.S. Appl. No. 11/008,290, Jul. 21, 2006, 15 pgs.
Y. Terao et al., U.S. PTO Office Action, U.S. Appl. No. 11/008,350, Jul. 06, 2006, 12 pgs.
Y. Terao et al., U.S. PTO Office Action, U.S. Appl. No. 11/085,226, Jul. 20, 2006, 12 pages.
Y. Terao et al., U.S. PTO Office Action, U.S. Appl. No. 11/085,227, Aug. 11, 2006, 15 pages.
Y. Terao et al., U.S. PTO Office Action, U.S. Appl. No. 11/085,240, Aug. 02, 2006, 15 pages.
Y. Terao et al., U.S. PTO Office Action, U.S. Appl. No. 11/085,247, Jul. 13, 2006, 14 pgs.
Y. Terao et al., U.S. PTO Office Action, U.S. Appl. No. 11/085,248, Jul. 05, 2006, 15 pgs.
Y. Terao et al., U.S. PTO Office Action, U.S. Appl. No. 11/085,256, Jul. 13, 2006, 13 pgs.
Y. Terao et al., U.S. PTO Office Action, U.S. Appl. No. 11/085,625, Jul. 28, 2006, 13 pgs.
Y. Terao, et al., Notice of Allowance and Fee(s) Due, U.S. Appl. No. 11/008,122, Jul. 26, 2006, 8 pgs.
Y. Terao et al., U.S. PTO Office Action, U.S. Appl. No. 11/008,381, Aug. 23, 2006, 17 pgs.
Y. Terao et al., U.S. PTO Office Action, U.S. Appl. No. 11/008,567, Aug. 21, 2006, 14 pgs.

* cited by examiner

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-281772, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing and a waiting tray for use in the post-process apparatus.

2. Description of the Related Art

A post-process apparatus comprises: a processing tray for bundling sheets sent from an image forming apparatus, thereby carrying out, for example, staple processing, and ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed. In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese Patent Document 2: Jpn. Pat. Appln. KOKAI Publication No. 11-322162 discloses a mechanism configured to provide a paddle on a staple tray for temporarily holding a sheet so as to be substantially constantly maintain a contact pressure of the paddle with respect to a sheet at the top level ejected on the tray. This mechanism prevents excessive return of the sheet due to a change of a contact area of pulling means with respect to the sheet at the top level. This mechanism is technically different from that of the present invention, and advantageous effect of the present invention cannot be attained by this mechanism.

BRIEF SUMMARY OF THE INVENTION

The Inventors proposes here that a waiting tray is newly allocated as a buffer mechanism at an upper stage of a processing tray. The waiting tray according to this proposal is allocated to be proximal to the upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space. As a result, a post-process apparatus can be made compact. Moreover, it is possible to sent the sheets to the processing tray without any malfunction.

However, when a sheet support face of the waiting tray is released (when a sheet is dropped onto the processing tray), the sheet is pulled to either of the left and right sheet support faces. Thus, there is a danger that the sheet is dropped onto the processing tray while it is shifted in its widthwise direction (in a transverse direction when the sheet transport direction is defined as a longitudinal direction).

It is an object of the present invention to provide a sheet post-process apparatus and a waiting tray capable of retaining a sheet at a center location without being pulled to the left or right when the sheet retained on the waiting tray is released from being retained in a waiting mode, thereby making it possible to reliably drop the sheet in a desired location of the processing tray.

In order to solve the above described problem, the present invention comprises the following features.

1. A sheet post-process apparatus, the apparatus comprising:

a waiting tray which temporarily retains a transported sheet in a waiting mode and releases the retention to drop the sheet;

a processing tray which bundles the sheets dropped from the waiting tray to carry out predetermined processing and ejects the sheet; and a storage tray which holds the bundle of sheets processed and ejected on the processing tray, wherein the waiting tray comprises:

left and right lower face support members which support left and right lower faces in a sheet transport direction during retention in a waiting mode and release the support on the left and right lower faces during release of the retention;

a distal end lower face support member which supports a distal end lower face of the sheet transported to the waiting tray;

a distal end upper face retainer member which retains a distal end upper face of the sheet transported to the waiting tray;

sensor means for sensing that a sheet has been held on the waiting tray; and driver means for, based on a sense signal of the sensor means, moving the distal end upper face retainer member to a location for retaining the distal end upper face of the sheet transported to the waiting tray.

2. A post-process apparatus according to 1, further comprising:

a first rotary shaft allocated in association with a distal end face in a transport direction of a sheet to be retained in a waiting mode, the first rotary shaft projecting the distal end lower face support member; and a second rotary shaft allocated coaxially of the first rotary shaft, the second rotary shaft projecting the distal end upper face retainer member, and being driven by the driver means independent of the first rotary shaft.

3. A sheet post-process apparatus according to 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are shorter in length in a sheet transport direction thereof than a length of a standard sheet to be held, and a part of the proximal end side in the transport direction of the sheet to be held on the processing tray is held on the storage tray.

4. A waiting tray for use in a sheet post-process apparatus, for temporarily retaining a transported sheet in a waiting mode, followed by releasing the retention, thereby making it possible to drop the sheet onto a processing tray, the waiting tray comprising:

left and right lower face support members which support left and right lower faces in a sheet transport direction during retention in a waiting mode and release the support on the left and right lower faces during release of the retention;

a distal end lower face support member which supports a distal end lower face of the sheet transported to the waiting tray;

a distal end upper face retainer member which retains a distal end upper face of the sheet transported to the waiting tray;

sensor means for sensing that a sheet has been sensed on the waiting tray; and driver means for, based on a sense signal of the sensor means, moving the distal end upper face retainer member to a location for retaining the distal end upper face of the sheet transported to the waiting tray.

5. A waiting tray according to 3, further comprising:

a first rotary shaft allocated in association with a distal end face in a transport direction of a sheet to be retained in a waiting mode, the first rotary shaft projecting the distal end lower face support member; and a second rotary shaft allocated coaxially of the first rotary shaft, the secondary rotary shaft projecting the distal end upper face retainer member, and being driven by the driver means independent of the first rotary shaft.

6. A waiting tray according to 3, wherein the distal end upper face retainer member is composed of a flexible elastic member and has a length which is sufficient to compress the distal end upper face of the sheet.

7. A waiting tray according to 3, wherein the distal end upper face retainer member is provided so as to compress a center portion of the distal end upper face of the sheet transported to the waiting tray, and the distal end lower face support member is provided so as to support the distal end lower faces on both sides of the distal end upper face retainer member.

8. A waiting tray according to 3, wherein the distal end retainer member is allocated in plurality with intervals on a peripheral face of the second rotary shaft.

9. A sheet post-process apparatus, the apparatus comprising:

waiting means for temporarily retaining a transported sheet in a waiting mode and releasing the retention to drop the sheet;

processing means for bundling the sheets dropped from the waiting means to carry out predetermined processing and ejecting the sheet; and storage means which holds the bundle of sheets processed and ejected by the processing means, wherein the waiting means comprises:

left and right lower face support means for supporting left and right lower faces in a sheet transport direction during retention in a waiting mode and releasing the support on the left and right lower faces during release of the retention;

distal end lower face support means for supporting a distal end lower face of the sheet transported to the waiting means;

distal end upper face retainer means for retaining a distal end upper face of the sheet transported to the waiting means;

sensor means for sensing that a sheet has been held on the waiting tray; and driver means for, based on a sense signal of the sensor means, moving the distal end upper face retainer member to a location for retaining the distal end upper face of the sheet transported to the waiting tray.

In the present specification and claims, a proximal end side, a distal end side, and a sheet width are defined as follows. That is, when a transport direction of a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, a sheet denotes a copy sheet on which a toner image (developed image) is copied and which is sent from the image forming apparatus.

On the waiting tray, the left and right lower face support members are opened, and the support of the sheet is released when the retention of the sheet is released (when the sheet is dropped on the processing tray). At this time, there is a danger that the sheet is pulled to one of the left and right lower face support members, and a location of a widthwise direction of the sheet (in a transverse direction when the sheet transport direction is defined as a reference) is shifted. According to the present invention, a sheet distal end lower face is supported by a distal end lower face support member, and a sheet distal end upper face is retained by a distal end upper face retainer member. Thus, the shift of the sheet can be prevented, and the sheet can be dropped in a desired location of the processing tray.

DETAILED DESCRIPTION OF THE INVENTION

Now, one embodiment of the present invention will be described here.

(General Description of Image Forming Apparatus)

Figure 18:
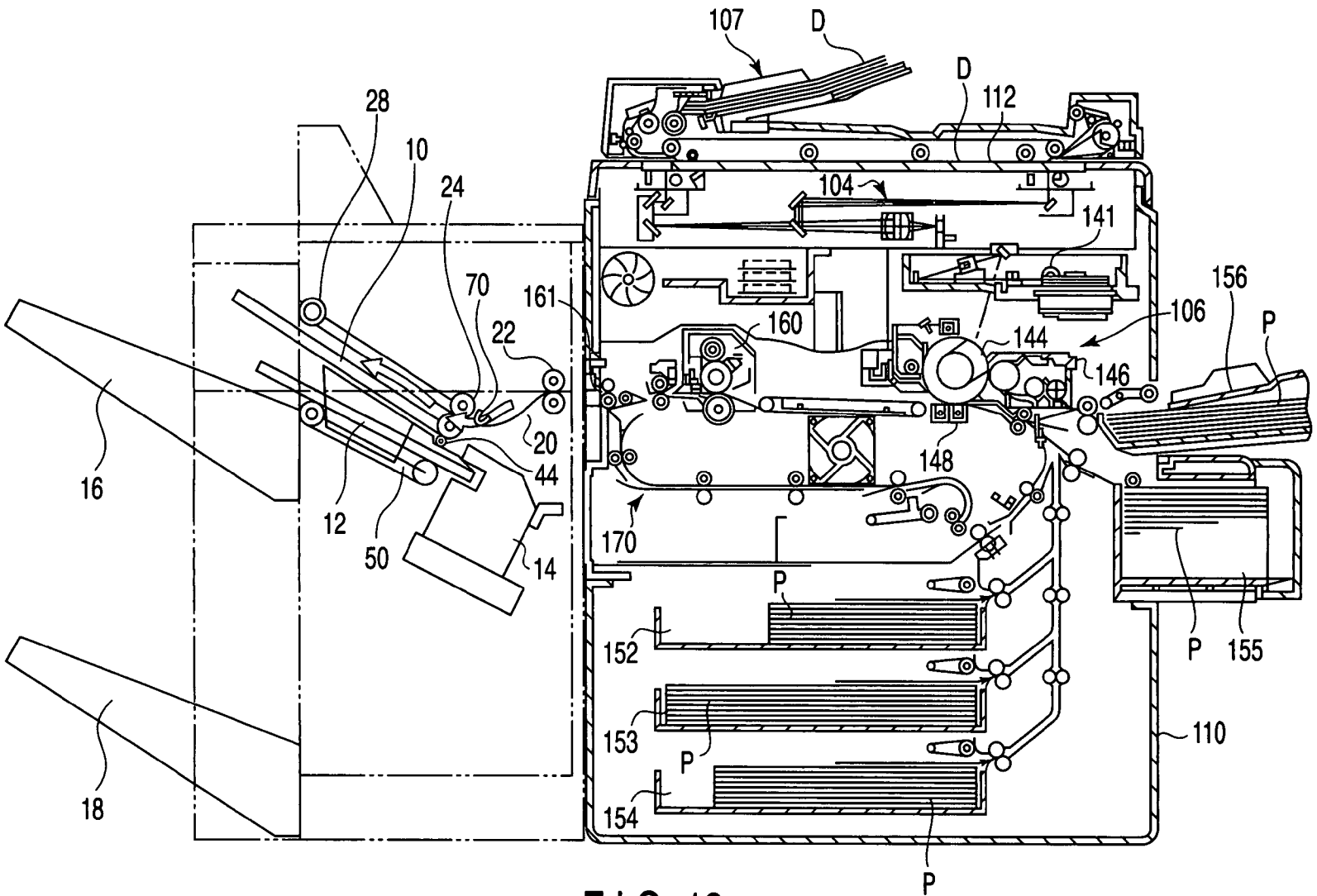
FIG. 18 is a view showing a combination of the post-process apparatus and the image forming apparatus according to the present invention.

A general description of an image forming apparatus (digital copying machine) allocated at a front stage of a post-process apparatus according to the present invention will be given with reference to FIG. 18. A manuscript placement base 112 is provided at an upper face of this apparatus. An auto document feeder 117 (hereinafter, referred to as an ADF) for automatically feeding a document D onto the manuscript placement base 112 is allocated on the manuscript placement base. The manuscript D is placed on the ADF, predetermined settings (such as the presence of absence of staple processing, how to carry out staple processing, the number of copies, or size of sheet to be copied, for example), and then, a copy start button is pressed. The manuscript D on the ADF is transported to a predetermined location of the manuscript placement base 112.

A scanner unit 4, a printer unit 6, and a copy sheet cassette and feeder are arranged at the inside of the image forming apparatus. At the scanner unit 4, the manuscript D on the manuscript placement base 112 is scanned, and reflection light thereof is incident. The incident reflection light is converted in a photoelectric manner, image information on the manuscript D is read, and a photoelectric signal corresponding to the read image information is output. At the printer unit 6, according to the image information or the like on the manuscript D read by the scanner unit 4, an electrostatic latent image is formed on a peripheral face of a photosensitive drum 144 by a semiconductor laser 141. Then, a toner is supplied from a developing device 146 to the photosensitive drum 144; the electrostatic latent image formed on the photosensitive drum 144 is substantially produced, and a tone image is formed.

To this photosensitive drum 144, a copy sheet P is sent from cassettes 52, 53, 54, and 56 or a feeder 55 of the copy sheet P, and the toner image on the photosensitive drum 144 is copied onto the copy sheet by a transfer charger 148. Then, the toner image of the copy sheet is fixed by a fixing device 160, and the fixed toner image is ejected from an ejection port 161. This sheet comes under the sheet of the present specification and claims.

In a control circuit of the image forming apparatus side, information concerning a sheet such as sheet size, the presence or absence of sort, or the presence or absence of staple processing is entered by operator's data input and/or an input signal from sensor means provided in the image forming apparatus. The control circuit at the image forming apparatus side sends information concerning a sheet transported to the control circuit of the post-process apparatus side based on these items of information. The information includes the following. For example, the sheet is provided as a sheet retained in the waiting tray in a waiting mode, the sheet being a sheet other than a last sheet to be held. The sheet is provided as a sheet retained in the standby sheet in a waiting mode, the sheet being a last sheet to be held. The sheet is provided as a sheet retained in the waiting tray in a waiting mode (a sheet being directly dropped on the processing sheet). The sheet is provided as a sheet being directly ejected to the storage tray without being dropped on the waiting tray. Information concerning dimensions of a sheet to be transported to the post-process apparatus (such as A3 or A4 size, for example) or sheet length (such as ordinary paper or a variety of cardboards, for example) is also sent from a control circuit at the image forming apparatus side to a control circuit at the post-process apparatus side.

Information concerning a length of a sheet which is larger than that of a set sheet is sensed by a sensor provided in the post-process apparatus. The sensed information is sent from this sensor to the control circuit at the post-process apparatus side.

(General Description of Post-process Apparatus)

A general description of the post-process apparatus will be given with reference to FIG. 18. The post-process apparatus is provided as an apparatus for bundling sheets 20 transported from an image forming apparatus, thereby carrying out staple processing or the like. This post-process apparatus is allocated in contact with the ejection port 161 of the image forming apparatus. That is, a sheet transport inlet is provided in association with the ejection port 161 of the image forming apparatus, and an inlet roller 22 is allocated in this sheet transport inlet. The inlet roller 22 introduces the sheets 20 into a paper pass ceiling 36 for forming a transport passage in the post-process apparatus (refer to FIG. 1). This paper pass ceiling 36 guides a sheet to a waiting tray 10 and a processing tray 12. Two storage trays 16 and 18 are allocated at the downstream side of the processing tray 12 (at the downstream side of the waiting tray 10).

The waiting tray 10 is allocated to be proximal to the upper stage of the processing tray 12 while the waiting tray is inclined so as to be upward at the proximal end side of the sheet to be transported and so as to be downward at the distal end side. A paper feed roller 24 is provided at the distal end side of this waiting tray 10 (at the upstream side of the sheet to be transported), and a waiting tray roller 28 is provided at the proximal end side of the tray (at the downstream side of the sheet to be transported). A sheet sensor 70 is provided at the transport inlet of the paper feed roller 24. This sensor senses a proximal end and a distal end of the sheet to be transported.

The processing tray 12 is allocated at the lower stage of the processing tray 12 while the processing tray is inclined so as to be upward at the proximal end side of the sheet (at the downward side of the sheet to be transported to the storage tray) and so as to be downward at the distal end side (upstream side of the sheet to be transported to the ejected paper storage tray). A stapler 14 is provided at the distal end side of the processing tray 12. A transport mechanism 50 is provided on the processing tray 12 so as to transport a bundle of staple processed sheets or the like to the storage tray 16 or 18.

Here, in the post-process apparatus according to the present invention, the waiting tray 10 and the processing try 12 both are small in size, as compared with the size of sheet to be transported in order to make equipment compact. Since the waiting tray 12 is small in size than a sheet to be held thereon, when a sheet is dropped from the waiting tray 10 to the processing tray 12, that sheet is held across the processing tray 12 and the storage tray 16 (or 18) (refer to FIGS. 10 to 13).

A control circuit of the post-process apparatus controls the waiting tray 10 to make a proper operation based on information concerning a sheet obtained from the control circuit at the image forming apparatus side and information available from the sheet sensor 70.

For example, when a sheet transported to the waiting tray is provided as a sheet which should be retained on the waiting tray in a waiting mode, the sheet being a sheet other than a last sheet to be held, this sheet is kept to be held in a proper location of the waiting tray.

When the above sheet is provided as a sheet to be retained on the standby sheet in a waiting mode, the sheet being a last sheet to be held, that sheet is aligned in a proper location, and is dropped on the processing tray together with the sheet which has been held in advance on the waiting tray.

When the sheet is provided as a sheet which is not required to be retained on the waiting tray in a waiting mode, that sheet is directly dropped on the processing tray.

When the sheet is provided as a sheet to be directly ejected on the storage tray without being dropped on the processing tray, that sheet is directly transported from the waiting tray to the storage tray without intervening the processing tray.

When the sheet is provided as a sheet which is larger than a set sheet (for example, a sheet of A3 in size), the waiting tray is increased in length by expanding it.

<Waiting Tray>

Figure 1:
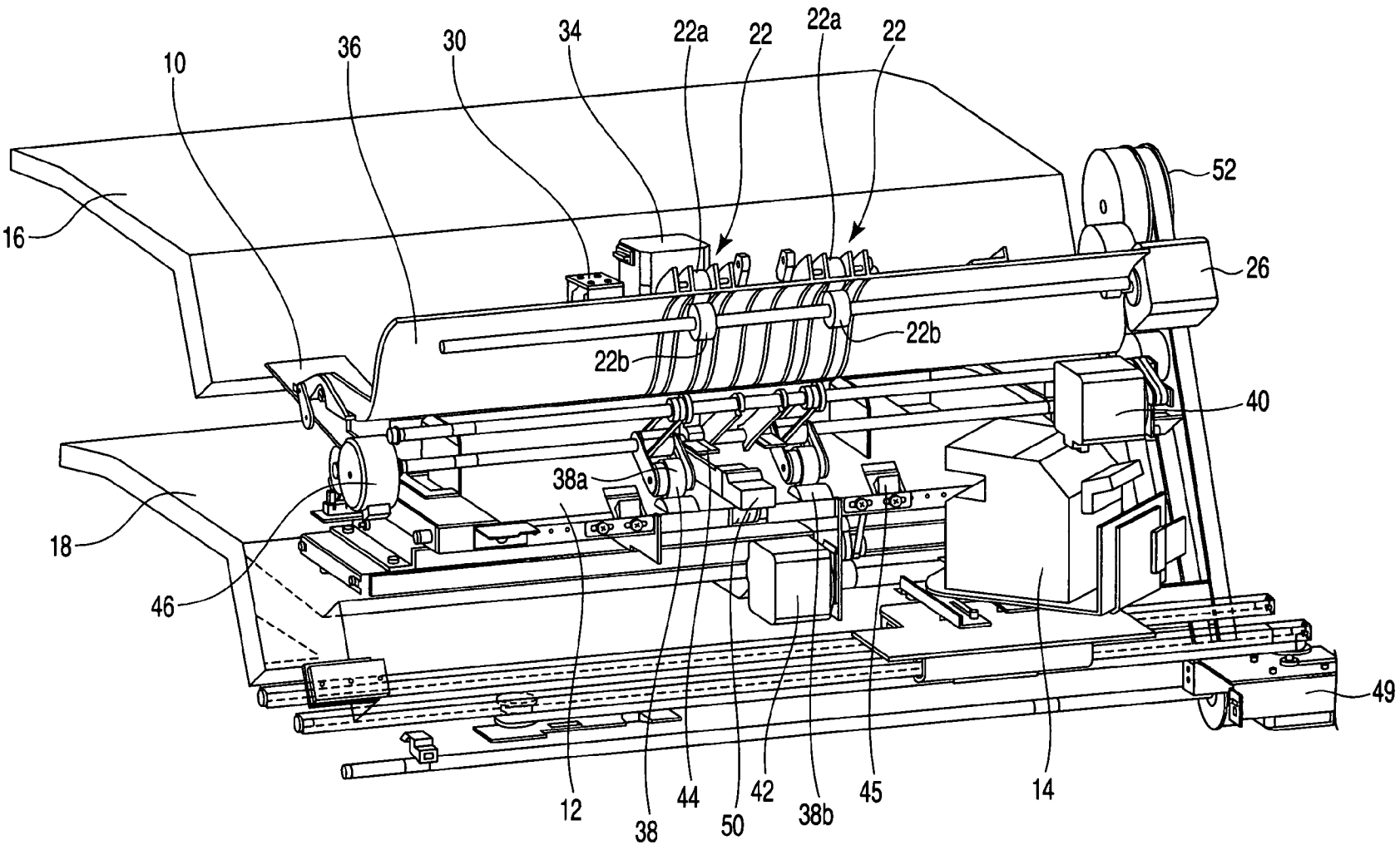
FIG. 1 is a perspective view of a post-process apparatus showing one embodiment of the present invention.
Figure 2:
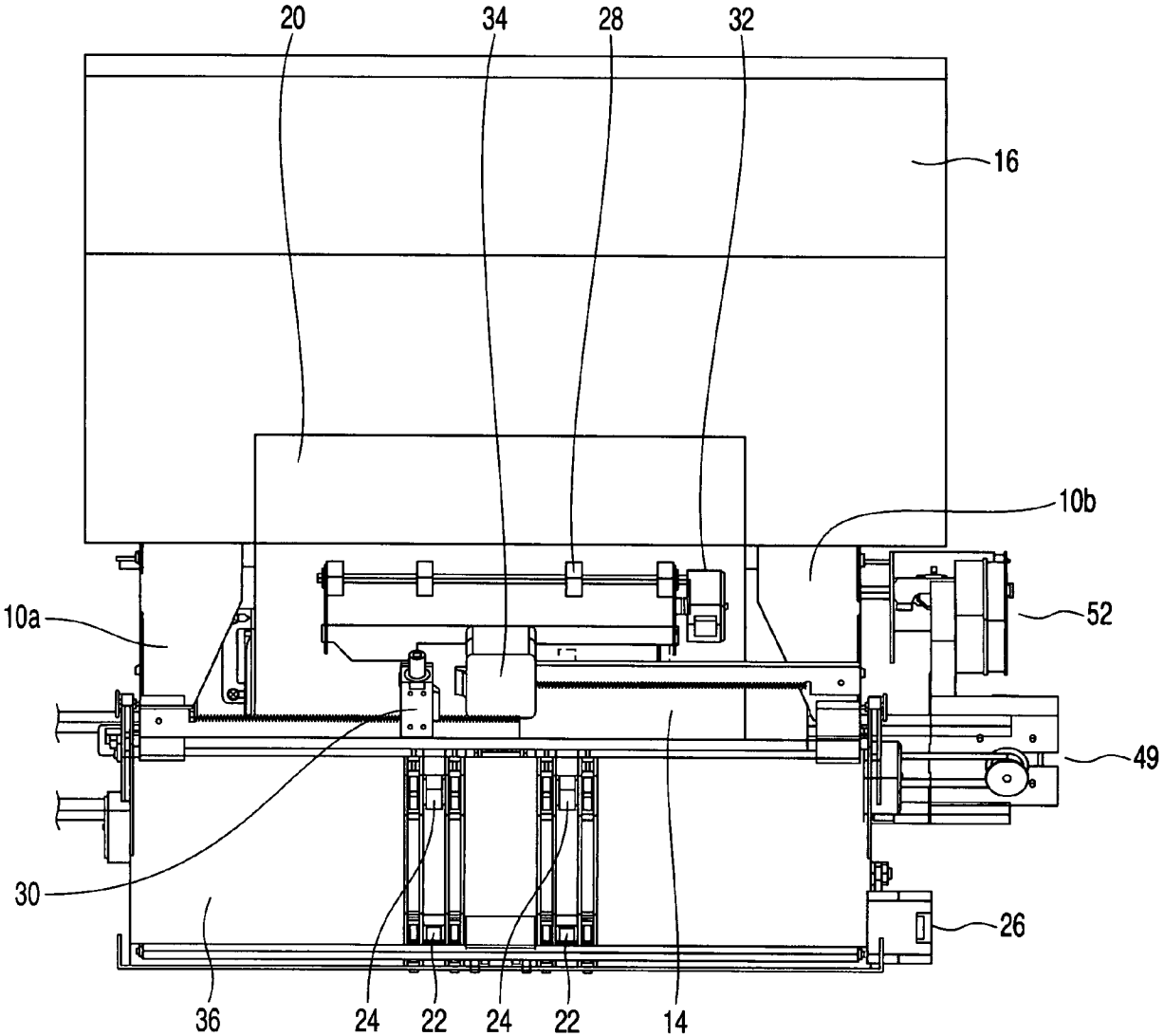
FIG. 2 is a top view of the post-process apparatus showing one embodiment of the invention.
Figure 3:
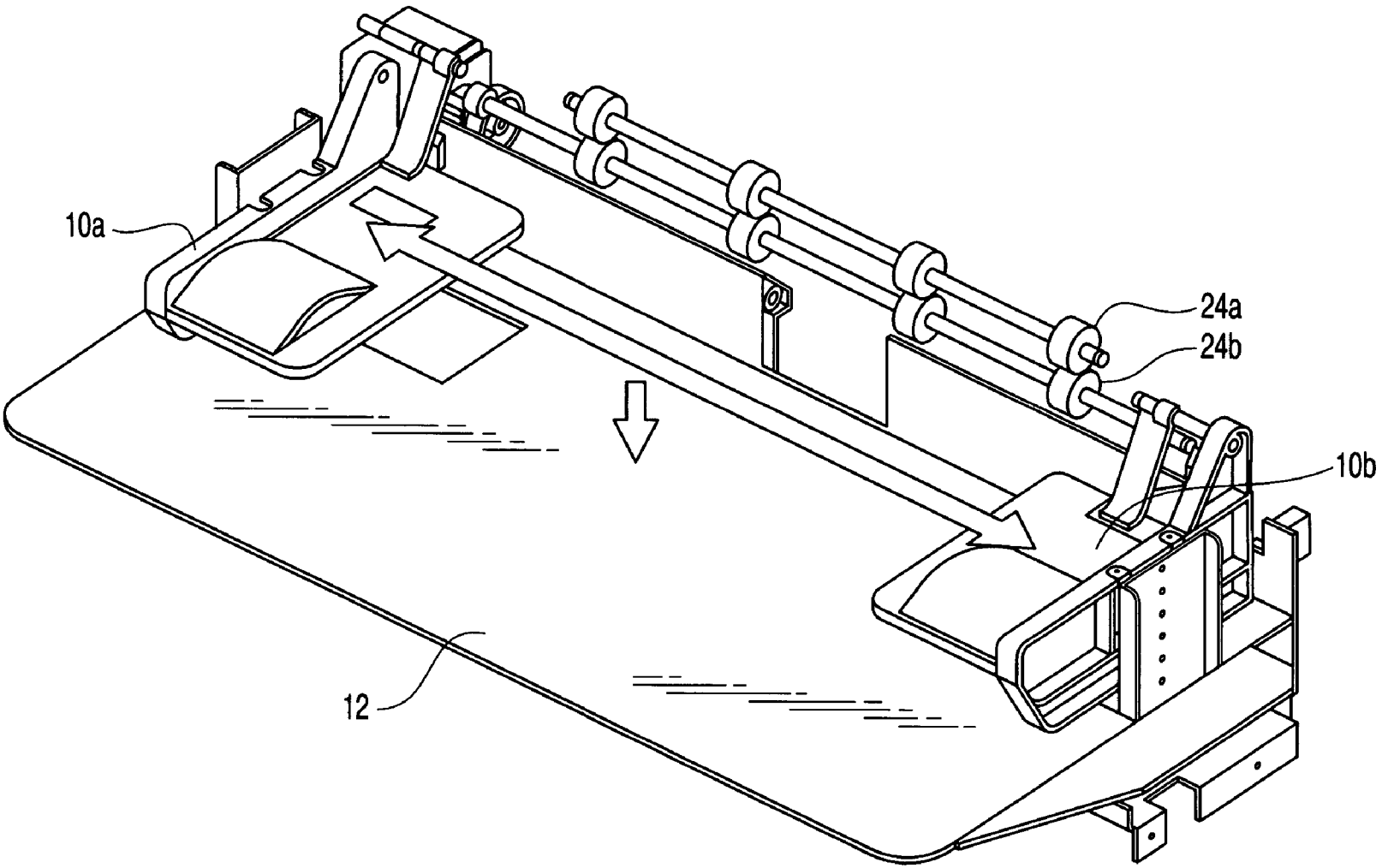
FIG. 3 is a view illustrating an operation of a waiting tray showing one embodiment of the invention.

The waiting tray will be described with reference to FIGS. 1, 2 and 3. As has been already described, when a preceding sheet is processed on the processing tray, a next sheet cannot be transported to the processing tray. A waiting tray makes the next sheet standby in this state. The inlet roller 22 includes an upper inlet roller 22*a* and a lower inlet roller 22*b*. These rollers are driven by an inlet roller motor 26. The paper feed roller 24 includes an upper paper feed roller 24*a* and a lower paper feed roller 24*b*. These rollers are driven by a paper feed roller motor. The waiting tray roller 28 can be operated to be vertically elevated. This vertically elevating operation is controlled by a waiting tray roller drive source 30. The waiting tray roller 28 enables normal and invert rotation. The normal and invert rotation is carried out by a waiting tray roller motor 32.

On the waiting tray 10, there are provided left and right lower face support members 10*a* and 10*b* for supporting both sides of the lower face of a sheet carried in the waiting tray in the left and right widthwise direction. A space between the left and right lower face support members is open. Therefore, a center portion of a sheet lower face is not supported. Although top faces of these left and right lower face support members 10*a* and 10*b* are formed in the flat shape, respectively, a curved face which is upwardly curved is formed at its proximal end side. Instead of the curved face or together with the curved face, a rotatable roller may be engaged in an arbitrary direction. The left and right lower face support members 10*a* and 10*b* are formed in the same width from its proximal end side to its distal end side (refer to FIG. 19). The width used here denotes a transverse direction in the case where a sheet transport direction is defined as a longitudinal direction. The left and right lower face support members 10*a* and 10*b* are set in a location in which a sheet side face can be supported on the full faces of the left and right lower face support members when the sheet is retained in a waiting mode. These support members are set in a location in which the left and right lower face support members 10*a* and 10*b* are released when retention in a waiting mode is released. When the left and right lower face support members 10*a* and 10*b* exist in this location, the sheet can be dropped from the distal end to the processing tray 12. The left and right lower face support members 10*a* and 10*b* are driven by a waiting tray motor 34. By means of this waiting tray motor 34, the left and right lower face support members are operated to be slid to adjust an opening width of an opening portion, and the left and right lower face support members 10*a* and 10*b* are opened or closed.

The waiting tray roller 28 returns the sheet transported to the waiting tray to the distal end side; the distal end side of the sheet is abutted against a distal end 60 of the waiting tray so as to align the sheet distal end. In this case, when the sheet is transported to the waiting tray, the sheet is located upwardly. When alignment is made, the roller is lowered. Then, the roller is rotated while the sheet is compressed, thereby push back the sheet. In addition, in the case where the sheet is transported from the waiting tray directly to the storage tray as well, this sheet alignment roller is lowered. Then, the roller is rotated while the sheet is compressed, and the sheet is ejected. In this case, the rotation direction of the waiting tray roller 28 is inverted from a case in which the sheet is abutted against the distal end side.

On the waiting tray, there is provided a sheet sensor 70 (refer to FIG. 18 or the like) for sensing a sheet proximal to the paper feed roller 24, i.e., at a side (upstream side) at which the sheet is carried into the waiting tray. This sheet sensor 70 senses the start of transport (sheet distal end) of the sheet by the paper feed roller 24 and the end of transport (sheet distal end) by the paper feed roller 24, and feeds this sense signal to control means.

Figure 19:
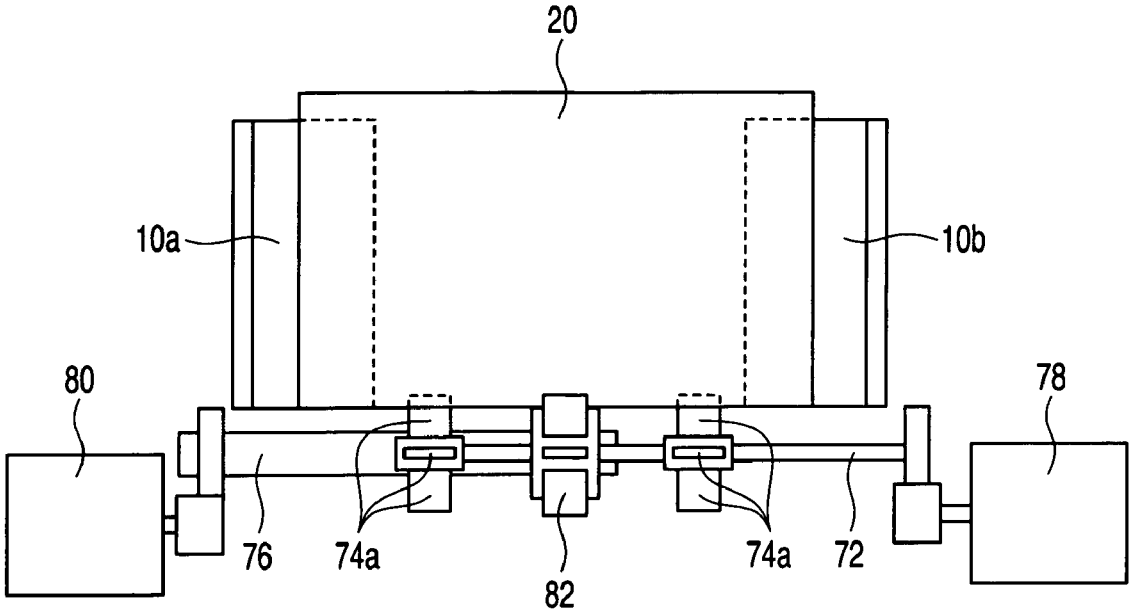
FIG. 19 is a top view of a structure of the distal end portion of a waiting tray showing one embodiment of the invention.
Figure 20:
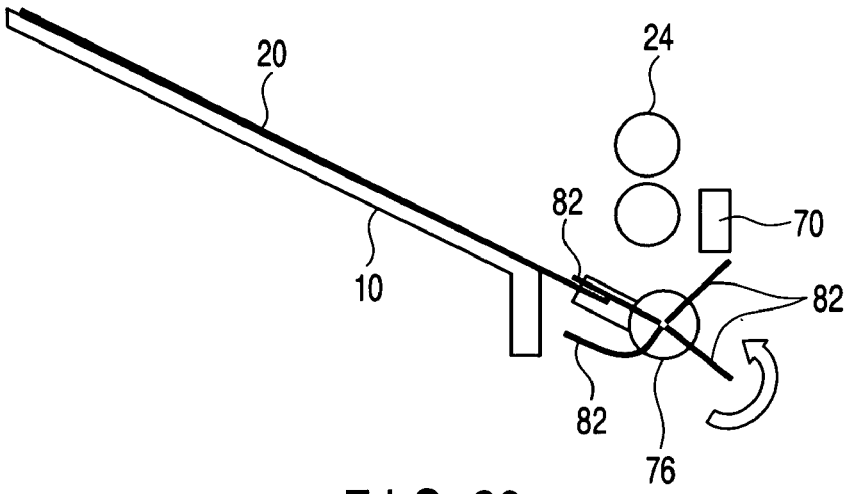
FIG. 20 is a view showing actuation of the distal end portion of the waiting tray showing one embodiment of the invention.

FIG. 19 is a plan top view of the distal end side of the waiting tray and FIG. 20 is a side view thereof. A first rotary shaft 72 is arranged below the inlet roller 22 along the distal end face of the sheet to be retained in a waiting mode. On this first rotary shaft 72, distal end lower face support members 74*a*, 74*a* are projected at two portions at both of the left and right sides of the sheet distal end. Further, the distal end lower face support members are allocated at four portions at an angle of 90 degrees in a cross shape on the same peripheral face. The distal end lower face support members 74*a*, 74*a* are set in a location for supporting the sheet distal end lower face, as shown in FIG. 19, when the sheet is retrained in a waiting mode. When retention of the sheet is released, these members are rotatably driven by the first rotary shaft 72 to be moved in a downward direction so as to release the support on the distal end lower face. The distal end lower face support members each are made of a resin or the like.

Furthermore, a second rotary shaft 76 is arranged below the inlet roller 22 along the distal end face of the sheet to be retained in a waiting mode. This second rotary shaft 76 is allocated coaxially of the first rotary shaft 72. However, the second rotary shaft 76 is driven independent of the first rotary shaft 72. That is, the first rotary shaft 72 is rotatably driven by a first rotary shaft drive motor 78. The second rotary shaft 76 is rotatably driven by a second rotary shaft drive motor 80. On the second rotary shaft 76, a distal end upper face retainer member 82 is projected at a center portion of the sheet distal end face. The distal end upper face retainer members 82 are allocated at four portions at an angle of 90 degrees in a cross shape on the same peripheral face. When the distal end of a predetermined sheet is transported to the waiting tray, the distal end upper face retainer members 82 are rotated to retain the center portion of the sheet distal end upper face. Then, the distal end upper face retainer members 82 each are made of a soft rubber or the like.

Next, when retention in a waiting mode on the waiting tray 10 is released, the left and right lower face support members 10*a* and 10*b* open. At this time, the sheet distal end is retained by the distal end lower face support members 74*a*, 74*a* and the distal end upper face retainer member 82. Thus, the sheet is not shifted in the left and right direction (widthwise direction). Then, the distal end lower face support members 74*a*, 774*a* and the distal end upper face retainer member 82 are rotated by the first rotary shaft 72 and the second rotary shaft 76, respectively. Then, retention of the sheet distal end is released by means of the distal end lower face support members 74*a*, 74*a* and the distal end upper face retainer member 82, and the sheet is dropped on the processing tray 12.

Before a next sheet reaches the waiting tray, the distal end lower face support members 74*a*, 74*a* move to a location which is rotated by 90 degrees from an original location. Then, the next distal end lower face support members 74*a*, 74*a* reach a location for supporting the sheet distal end lower face. The distal end upper face retainer member 82 moves to a location rotated at 90 degrees from an original location, and the next distal end upper face retainer member 82 reaches a ready location for retaining the sheet distal end upper face.

<Processing Tray>

The processing tray carries out longitudinal and transverse alignments with respect to a bundle of sheets dropped from a waiting tray and carries out predetermined processing (for example, staple processing). This processing tray is allocated in an inclined shape which is high at its proximal end side and which is low at its distal end side.

Figure 4:
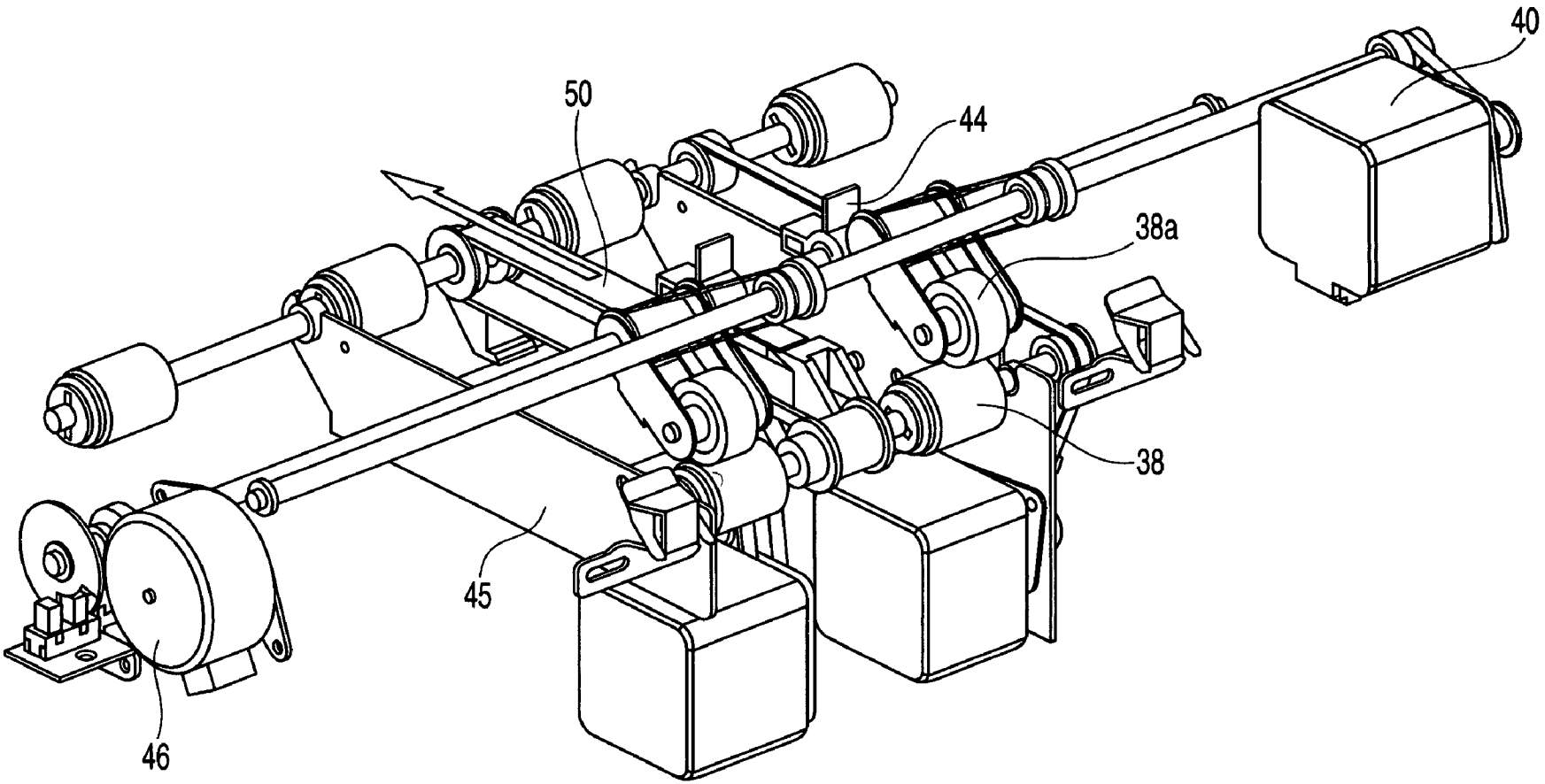
FIG. 4 is a view illustrating a longitudinal alignment and sheet bundle transport mechanism of the post-process apparatus showing one embodiment of the invention.

As shown in FIG. 4, longitudinal alignment is carried out by a longitudinal alignment roller 38. A longitudinal alignment upper roller 38*a* is driven by a longitudinal alignment upper roller motor 40. A longitudinal alignment lower roller 38*b* is driven by a longitudinal alignment lower roller motor 42. Then, sheets are aligned while a stopper 45 is defined as a reference. In addition, in order to assist this alignment, a paddle 44 is provided. This paddle 44 is driven by a paddle motor 46.

Figure 5:
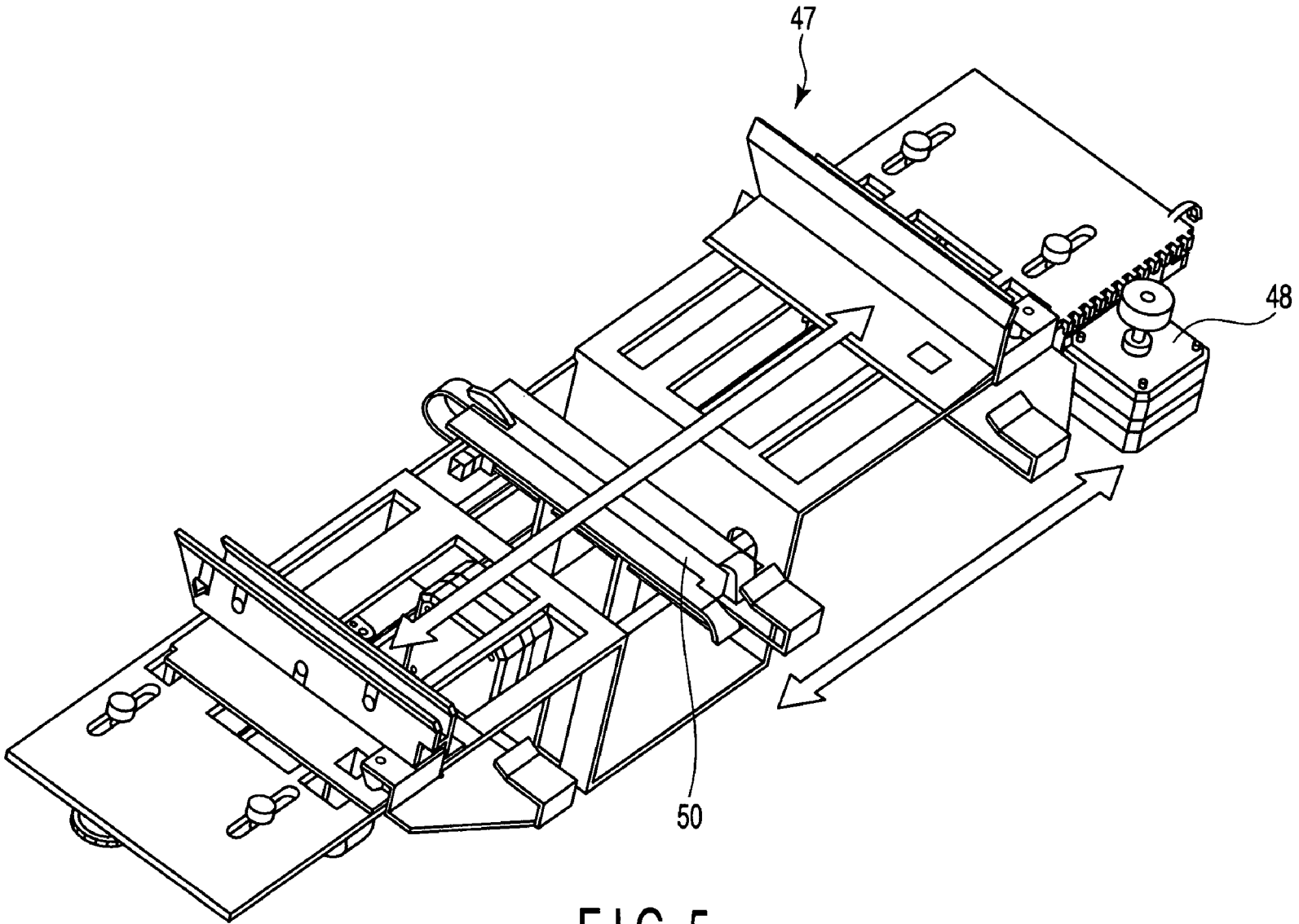
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

On the processing tray 12, when a predetermined number of sheets are aligned and stacked, staple processing is carried out by the stapler 14.

Figure 6:
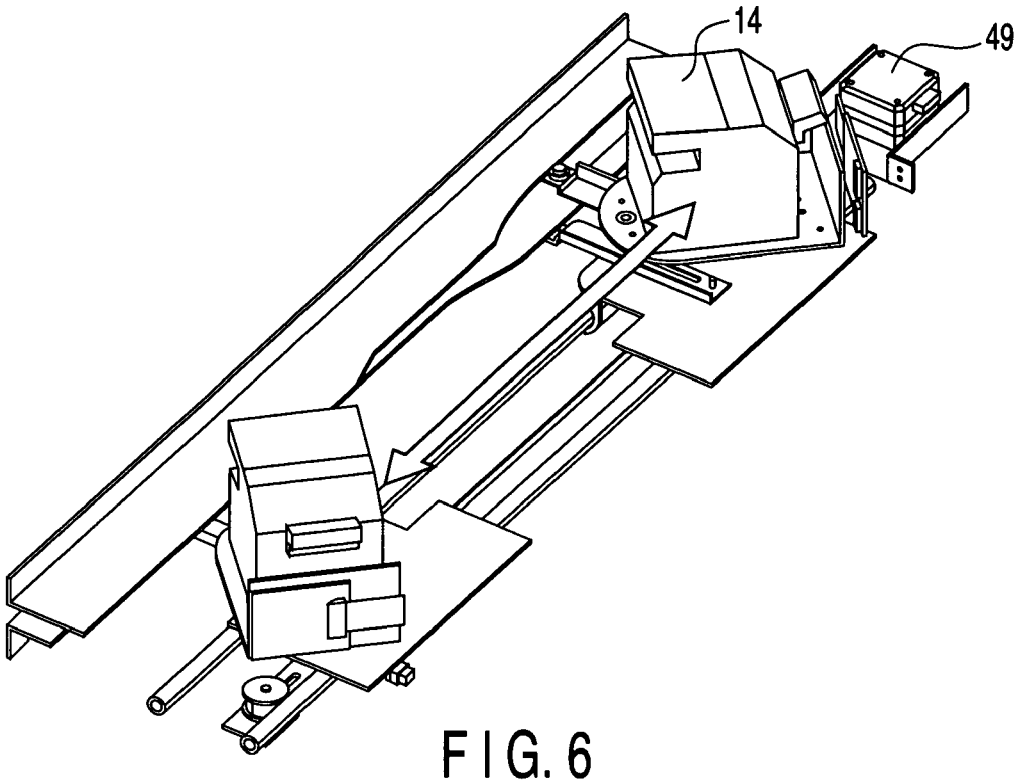
FIG. 6 is a view illustrating an operation of a stapler of the post-process apparatus showing one embodiment of the invention.
Figure 7:
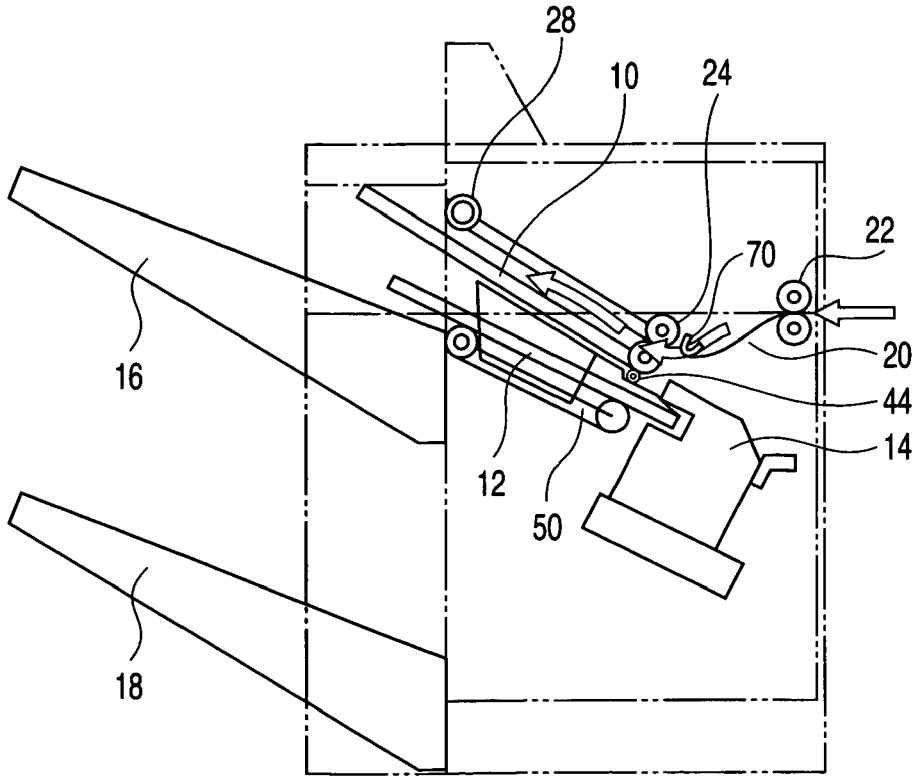
FIG. 7 is a view illustrating a flow of a first sheet of sheets between an inlet roller and a paper feed roller in the post-process apparatus showing one embodiment of the invention.
Figure 8:
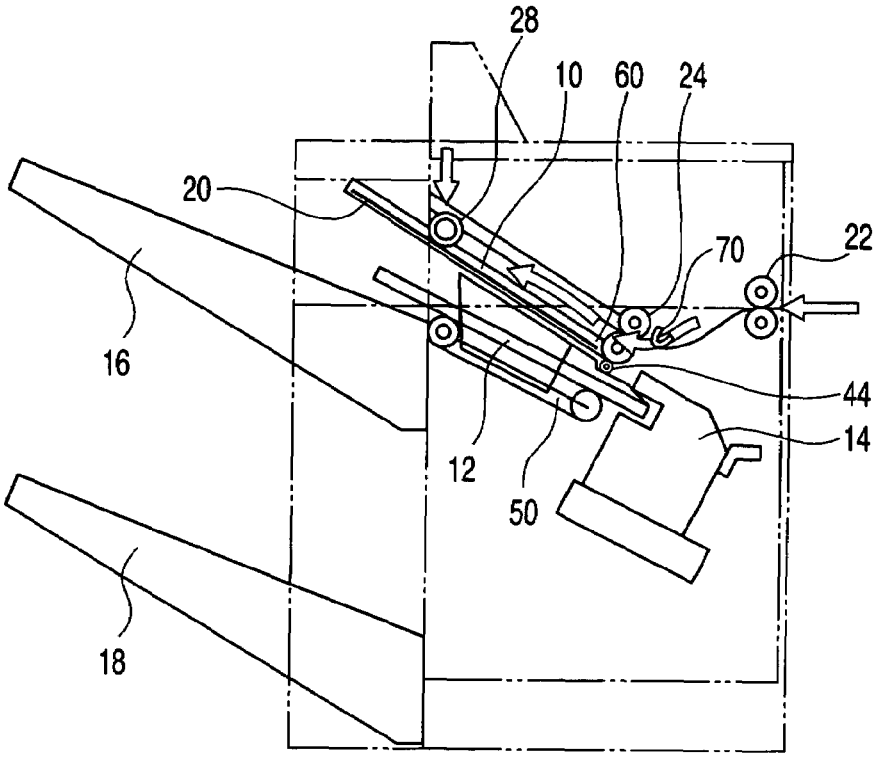
FIG. 8 is a view illustrating a flow of a first sheet of sheets between the paper feed roller and a standby roller in the post-process apparatus showing one embodiment of the invention.
Figure 9:
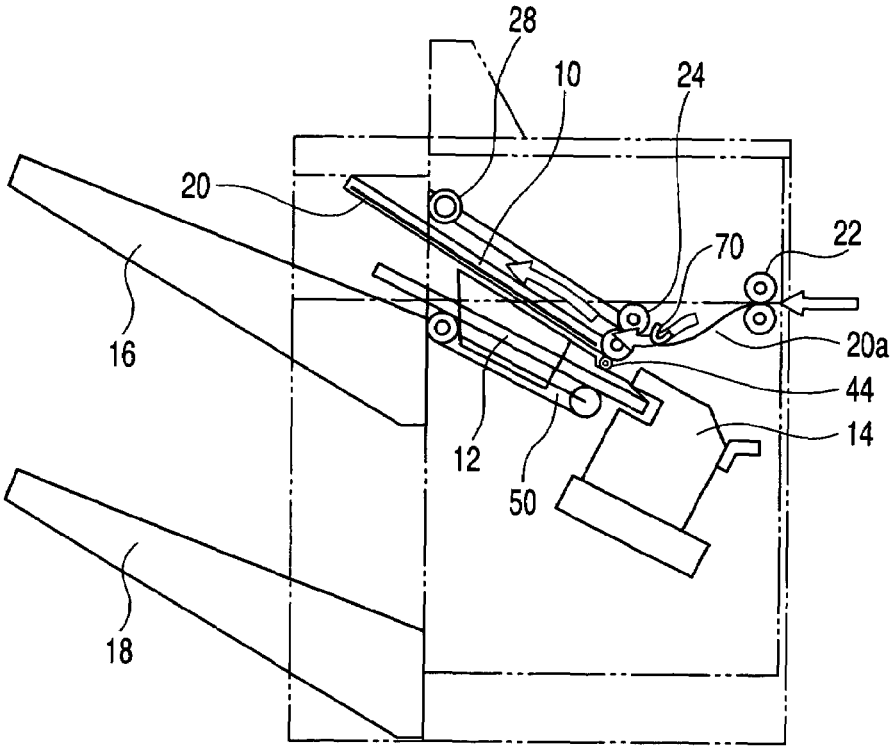
FIG. 9 is a view illustrating a flow of a second sheet of sheets between the paper feed roller and the standby roller in the post-process apparatus showing one embodiment of the invention.
Figure 10:
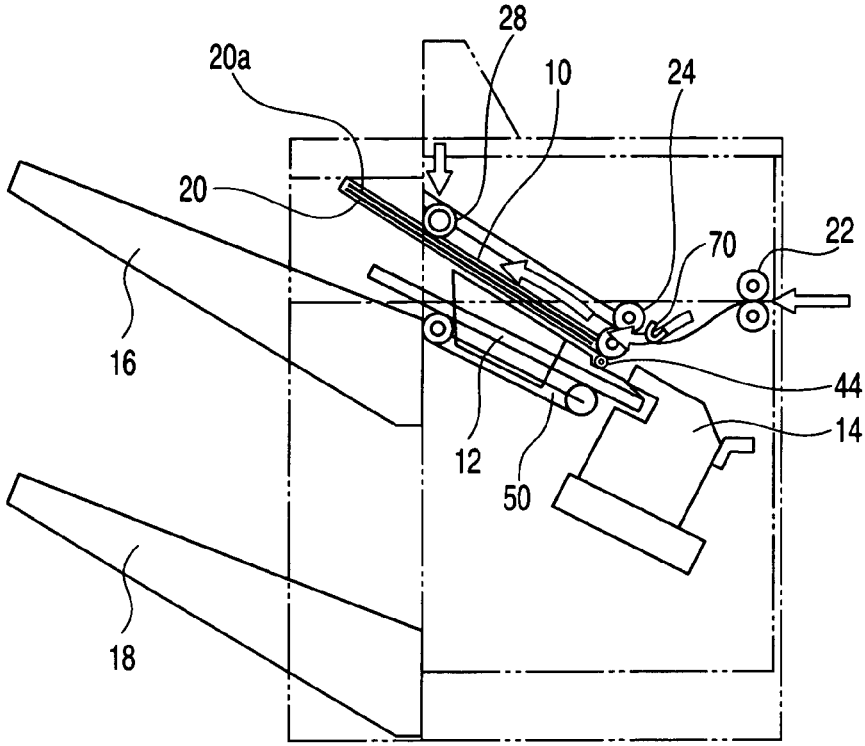
FIG. 10 is a view illustrating an operation of a waiting tray roller in the post-process apparatus showing one embodiment of the invention.

As shown in FIG. 6, the stapler 14 is positioned by means of a staple drive unit 49, and staple processing is controlled.

<Storage Tray>

As shown in FIG. 4, a bundle of staple processed sheets is sent to the storage tray 16 by a transport mechanism 50. Selection of the storage trays 16 and 18 is made by vertically moving the storage trays 16 and 18 by a storage tray drive unit 52.

In the case where a sheet is directly ejected from the waiting tray 10, the storage tray is risen up to a location which corresponds to a sheet outlet of the waiting tray.

(Description of Operation)

Now, an operation of the post-process apparatus according to the present invention will be described with reference to FIGS. 7 to 18.

<Operation in Case Where Staple Processing is Carried Out>

As has been already described, staple processing on the processing tray is slow as compared with processing on the image processing apparatus. Thus, when a sheet transported from the image processing apparatus is processed on the processing tray, a buffer unit is provided at a front stage thereof. It is necessary to make standby until a next sheet has been transported to the processing tray when the sheet transported from the image processing apparatus is processed on the processing tray. In this example, a description will be given with respect to a case in which two sheets (a first sheet and a second sheet) are made standby on the waiting tray, and the third and subsequent sheets are not required to be standby.

A first sheet from the image processing apparatus is transported to the waiting tray 10 via the inlet roller 22 and the paper feed roller 24. The sheet is retained by the left and right lower face support members 10*a* and 10*b* and the rear end retainer members 74*a*, 74*a*. In this retention state, the waiting tray roller 28 is lowered, and a sheet distal end is aligned (aligned to the distal end 60 (upstream side) of the waiting tray 10). Further, the distal end upper face retainer member 82 is rotated, and is positioned on the sheet upper face. The sheet distal end is retained by the distal end retainer members 74*a*, 74*a* and the distal end upper face retainer member 82.

Figure 11:
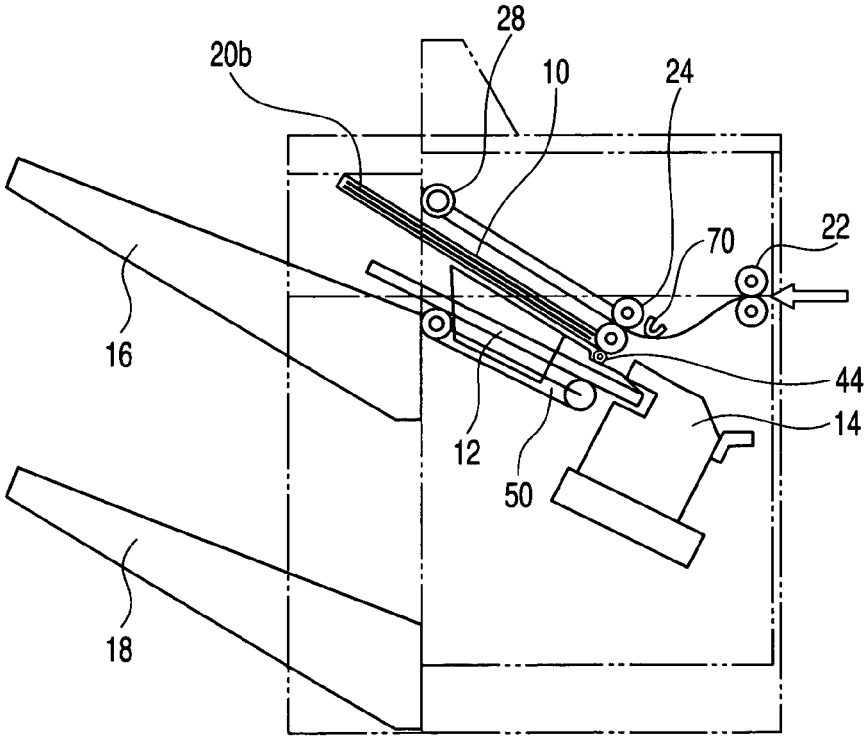
FIG. 11 is a view illustrating an operation of the waiting tray roller in the post-process apparatus showing one embodiment of the invention.
Figure 12:
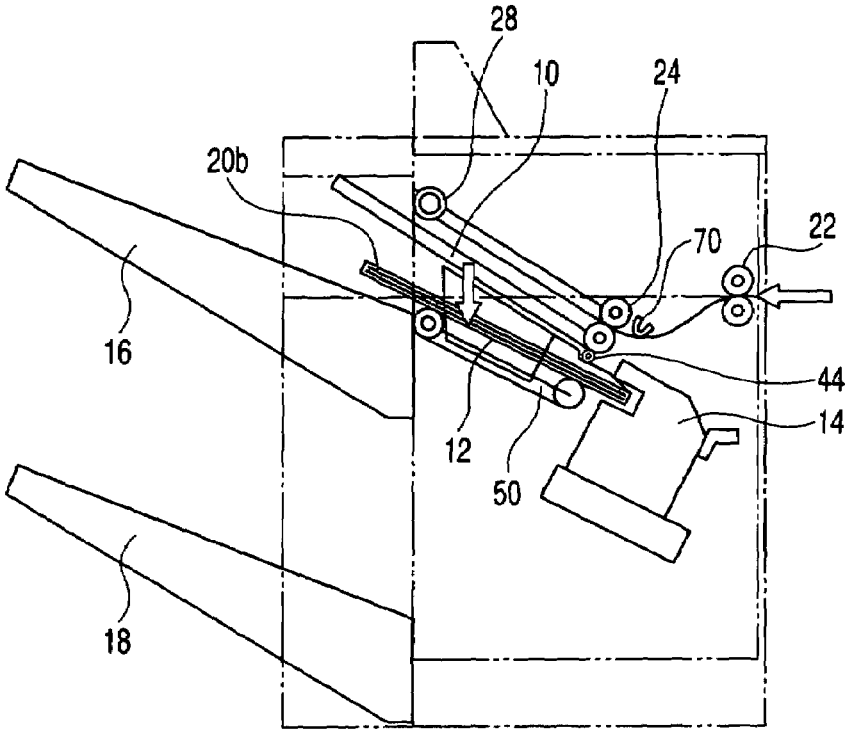
FIG. 12 is a view illustrating an operation of an active drop in the post-process apparatus showing one embodiment of the invention.

Next, the waiting tray roller 28 is risen, and is ready for receiving a second sheet 20*a*. When the second sheet 20*a* is sent to the waiting tray 10, the waiting tray roller 28 is lowered. A location of the sheet is aligned to the distal end 60 of the waiting tray 10. Then, the waiting tray roller 28 is risen (FIG. 11). When the second sheet is transported to the waiting tray, the distal end portion of the sheet is sensed by the sheet sensor 70. Based on this sense signal, a bundle of the first and second sheets is dropped onto the processing tray 12 altogether. That is, the left and right lower face support members 10*a* and 10*b* are opened to release the support on both sides of the sheet. At this time, the sheet distal end is retained by the distal end lower face support members 74*a*, 74*a* and the distal end upper face retainer member 82. Thus, the sheet is not shifted in a widthwise direction (transverse direction) by being affected by an opening operation of the left and right lower face support members 10*a* and 10*b*. Then, a timing is slightly shifted after release or from the start of release, and the first rotary shaft 72 and the second rotary shaft 74 are rotated to release retention of the sheet distal end by the distal end lower face support members 74*a*, 74*a* and the distal end upper face retainer member 82. By doing this, the sheet drops in a desired location of the processing tray 12 without being shifted in the left and right direction.

Then, the third and subsequent sheets are transported from the paper feed roller 24 directly to the waiting tray while the waiting tray is kept in a state in which the support of the sheet is released.

Figure 13:
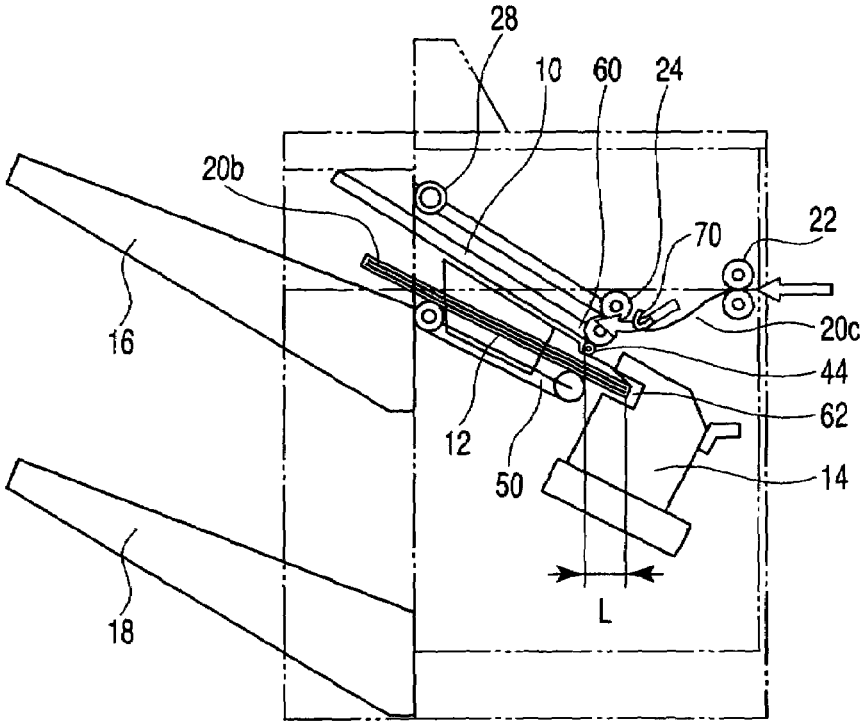
FIG. 13 is a view illustrating a flow of a third sheet of sheets in the post-process apparatus showing one embodiment of the invention.

In the processing tray 12, a predetermined number of sheet bundles 21 are formed to be stacked on two bundles of sheets 20*b*. At this time, longitudinal and transverse alignment mechanisms 38 and 47 function, and longitudinal and transverse sheet alignments are executed. At this time, as shown in FIG. 13, the distal end 60 of the waiting tray 10 and a distal end (upstream side) 62 of the processing tray 12 are spaced in a transverse direction with a distance L so that the distal end 60 of the waiting tray 10 exists at the downstream side more than the distal end 62 of the processing tray 12. With this construction, the bundle of sheets 20*b* is easily dropped from the waiting tray 10 to the processing tray 12, and an aligning operation by the longitudinal and transverse alignment mechanisms 38 and 47 can be easily carried out. As a result, an occurrence of jamming can be prevented.

The processing tray 12 is allocated to be obliquely inclined together with the waiting tray 10. Thus, the respective distal ends 60 and 62 are located at the lowest position. The sheets 20 and the bundle of sheets 21 can be aligned with the distal ends 60 and 62 by its own weight of the sheets 20 and the bundle of sheets 21.

Figure 14:
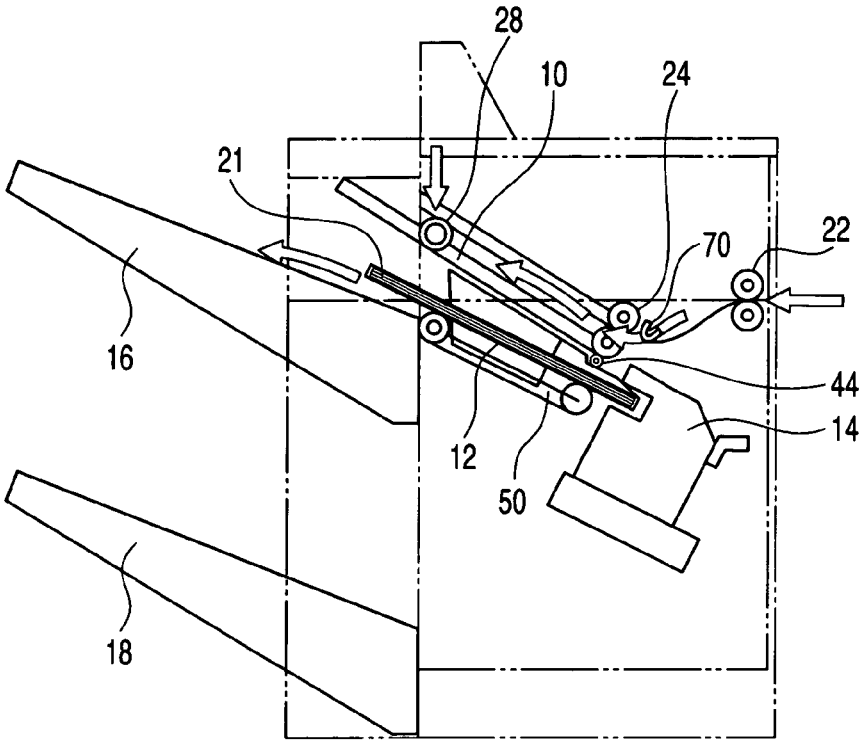
FIG. 14 is a view illustrating an operation of a stapler in the post-process apparatus showing one embodiment of the invention.
Figure 15:
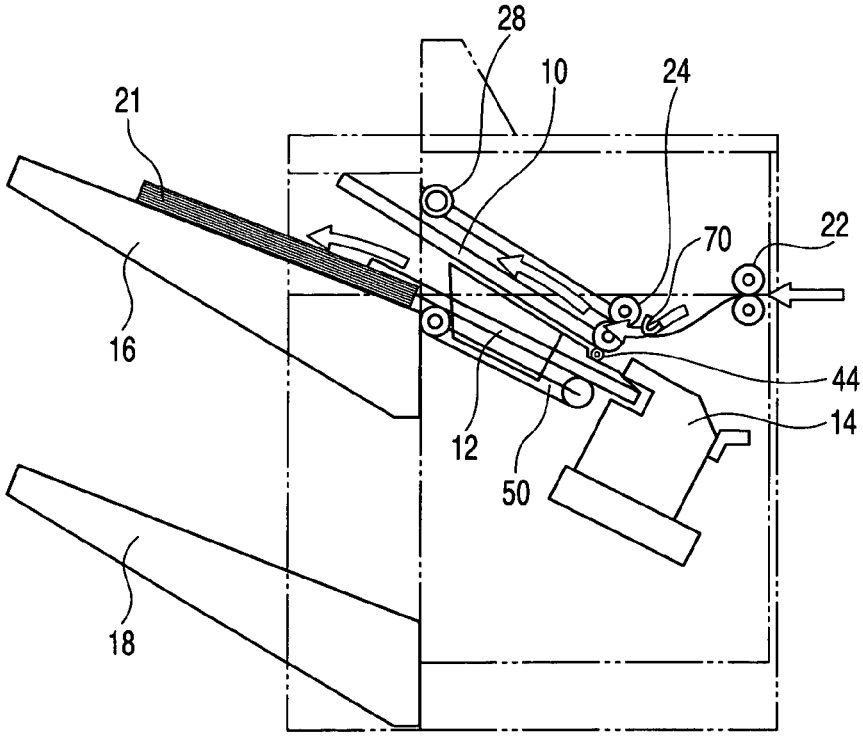
FIG. 15 is a view illustrating a flow of a bundle of sheets between a processing tray and a storage tray in the post-process apparatus showing one embodiment of the invention.

Next, as shown in FIG. 14, the bundle of sheets 21 is staple processed by the stapler 14. Then, as shown in FIG. 15, the bundle of sheets 20 is fed to the storage tray 16 by means of the transport mechanism 50, and post-process terminates.

<Operation in Case Where No Post-process is Required>

Figure 16:
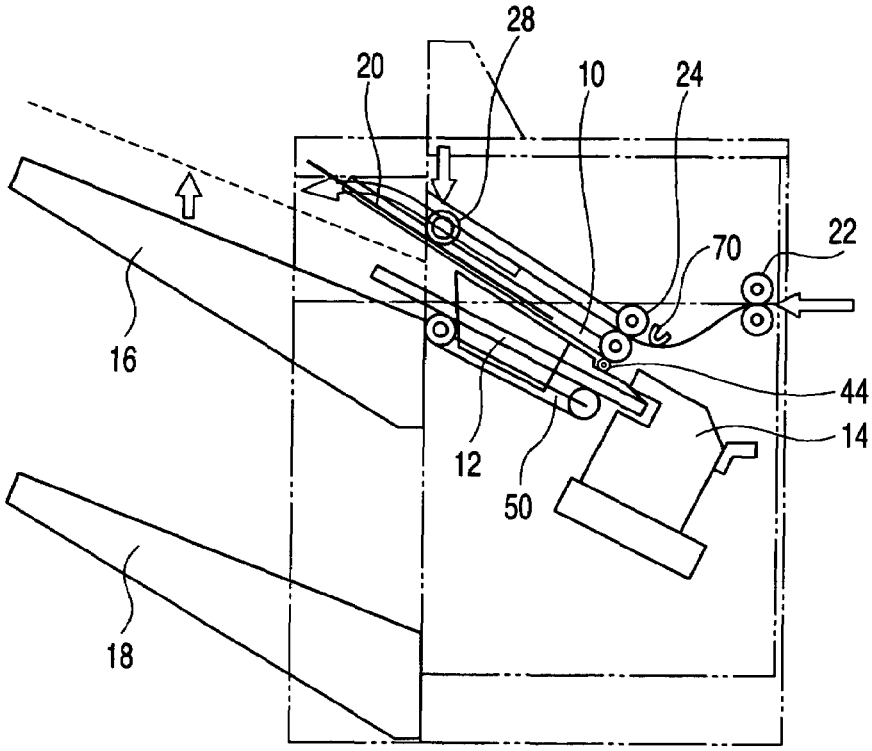
FIG. 16 is a view illustrating a flow of direct sheet ejection of a sheet from the waiting tray to the storage tray in the post-process apparatus showing one embodiment of the invention.
Figure 17:
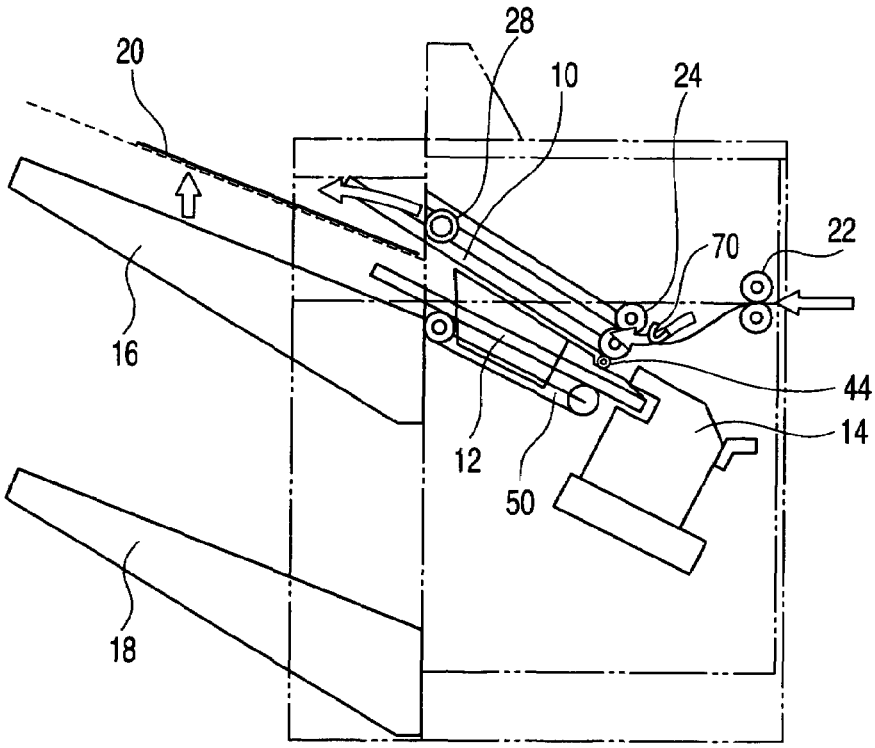
FIG. 17 is a view illustrating an operation of a position change of the storage tray in the post-process apparatus showing one embodiment of the invention.

In the case where no post-process is required (such as a case in which no staple processing is carried out or a case in which jamming has occurred), as shown in FIGS. 16 and 17, a sheet is ejected from the waiting tray 10 directly to the storage tray 16 without intervening the processing tray 12. As shown in FIG. 16, the sheet fed from the image processing apparatus is transported to the storage tray 16 via the inlet roller 22, the paper feed roller 24, and the waiting tray 10. The waiting tray roller 28 is lowered, and the sheets 20 are transported. The storage tray 16, as shown in FIG. 17, is slightly risen by the storage tray drive unit 52 to receive the sheets fed from the waiting tray 10.

Although embodiments of the present invention have been described above, the present invention is not limited to the embodiments. Constituent elements shown in the embodiments can be changed to other constituent elements as long as they have the same functions.

What is claimed is:

1. A sheet post-process apparatus, the apparatus comprising:

a waiting tray which temporarily retains a transported sheet in a waiting mode and releases the retention to drop the sheet;

a processing tray which bundles the sheets dropped from the waiting tray to carry out predetermined processing and ejects the sheet; and a storage tray which holds the bundle of sheets processed and ejected on the processing tray, wherein the waiting tray comprises:

left and right lower face support members which support left and right lower faces in a sheet transport direction during retention in a waiting mode and release the support on the left and right lower faces during release of the retention;

a distal end lower face support member which supports a distal end lower face of the sheet transported to the waiting tray;

a distal end upper face retainer member which retains a distal end upper face of the sheet transported to the waiting tray;

sensor means for sensing that a sheet has been held on the waiting tray; and driver means for, based on a sense signal of the sensor means, moving the distal end upper face retainer member to a location for retaining the distal end upper face of the sheet transported to the waiting tray.

2. A post-process apparatus according to claim 1, further comprising:

a first rotary shaft allocated in association with a distal end face in a transport direction of a sheet to be retained in a waiting mode, the first rotary shaft projecting the distal end lower face support member; and a second rotary shaft allocated coaxially of the first rotary shaft, the second rotary shaft projecting the distal end upper face retainer member, and being driven by the driver means independent of the first rotary shaft.

3. A sheet post-process apparatus according to claim 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are shorter in length in a sheet transport direction thereof than a length of a standard sheet to be held, and a part of the proximal end side in the transport direction of the sheet to be held on the processing tray is held on the storage tray.

4. A waiting tray according to claim 3, further comprising:

a first rotary shaft allocated in association with a distal end face in a transport direction of a sheet to be retained in a waiting mode, the first rotary shaft projecting the distal end lower face support member; and a second rotary shaft allocated coaxially of the first rotary shaft, the secondary rotary shaft projecting the distal end upper face retainer member, and being driven by the driver means independent of the first rotary shaft.

5. A waiting tray according to claim 3, wherein the distal end upper face retainer member is composed of a flexible elastic member and has a length which is sufficient to compress the distal end upper face of the sheet.

6. A waiting tray according to claim 3, wherein the distal end upper face retainer member is provided so as to compress a center portion of the distal end upper face of the sheet transported to the waiting tray, and the distal end lower face support member is provided so as to support the distal end lower faces on both sides of the distal end upper face retainer member.

7. A waiting tray according to claim 3, wherein the distal end retainer member is allocated in plurality with intervals on a peripheral face of the second rotary shaft.

8. A waiting tray for use in a sheet post-process apparatus, for temporarily retaining a transported sheet in a waiting mode, followed by releasing the retention, thereby making it possible to drop the sheet onto a processing tray, the waiting tray comprising:

left and right lower face support members which support left and right lower faces in a sheet transport direction during retention in a waiting mode and release the support on the left and right lower faces during release of the retention;

a distal end lower face support member which supports a distal end lower face of the sheet transported to the waiting tray;

a distal end upper face retainer member which retains a distal end upper face of the sheet transported to the waiting tray;

sensor means for sensing that a sheet has been sensed on the waiting tray; and driver means for, based on a sense signal of the sensor means, moving the distal end upper face retainer member to a location for retaining the distal end upper face of the sheet transported to the waiting tray.

9. A sheet post-process apparatus, the apparatus comprising:

waiting means for temporarily retaining a transported sheet in a waiting mode and releasing the retention to drop the sheet;

processing means for bundling the sheets dropped from the waiting means to carry out predetermined processing and ejecting the sheet; and storage means which holds the bundle of sheets processed and ejected by the processing means, wherein the waiting means comprises:

left and right lower face support means for supporting left and right lower faces in a sheet transport direction during retention in a waiting mode and releasing the support on the left and right lower faces during release of the retention;

distal end lower face support means for supporting a distal end lower face of the sheet transported to the waiting means;

distal end upper face retainer means for retaining a distal end upper face of the sheet transported to the waiting means;

sensor means for sensing that a sheet has been held on the waiting tray; and driver means for, based on a sense signal of the sensor means, moving the distal end upper face retainer member to a location for retaining the distal end upper face of the sheet transported to the waiting tray.

* * * * *